US007896263B2

(12) United States Patent
Matteucci et al.

(10) Patent No.: US 7,896,263 B2
(45) Date of Patent: Mar. 1, 2011

(54) FLUID INJECTOR

(75) Inventors: Luca Matteucci, Pisa (IT); Raffaele Squarcini, Livorno (IT)

(73) Assignee: Continental Automotive Italy S.p.A., Fauglia Pisa (IT)

( * ) Notice: Subject to any disclaimer, the term of this patent is extended or adjusted under 35 U.S.C. 154(b) by 356 days.

(21) Appl. No.: 10/598,351

(22) PCT Filed: Jan. 18, 2005

(86) PCT No.: PCT/EP2005/050192

§ 371 (c)(1),
(2), (4) Date: Aug. 7, 2007

(87) PCT Pub. No.: WO2005/083265

PCT Pub. Date: Sep. 9, 2005

(65) Prior Publication Data

US 2008/0147017 A1 Jun. 19, 2008

(30) Foreign Application Priority Data

Feb. 27, 2004 (EP) ..... 04004592

(51) Int. Cl.
*B05B 1/30* (2006.01)
*B05B 1/32* (2006.01)
*B05B 1/00* (2006.01)
*F02M 59/00* (2006.01)

(52) U.S. Cl. ..... 239/585.5; 239/456; 239/600; 239/585.1; 239/533.2; 123/498; 123/467

(58) Field of Classification Search ..... 239/456, 239/88, 600, 585.1, 533.2, 533.9, 585.5, 239/102.2; 251/337, 57, 129.06; 123/498, 123/467, 468, 472; 310/316.03, 317, 323.06
See application file for complete search history.

(56) References Cited

U.S. PATENT DOCUMENTS 5,178,362 A * 1/1993 Vogt et al. ..... 251/129.21

(Continued)

FOREIGN PATENT DOCUMENTS

DE 101 23 218 A1 11/2002

(Continued)

OTHER PUBLICATIONS

European Search Report and Written Opinion for European Patent Application No. EP 04004592.4 (6 pages), Aug. 4, 2004.

(Continued)

*Primary Examiner*—Len Tran
*Assistant Examiner*—Justin Jonaitis
(74) *Attorney, Agent, or Firm*—King & Spalding L.L.P.

(57) ABSTRACT

A fluid injector has an actuator unit, a cartridge, which has a recess, which on one of its open ends forms an injection nozzle and takes in a needle. The needle has a first and a second part (15, 17). The first part (15) is inserted into the recess and closes or opens the injection nozzle depending on the position of the first part (15). The second part (17) is coupled to the actuator unit on one of its free ends and is coupled to the first part (15) via a coupling unit. The coupling unit is arranged in positive connection to the first part (15) and is joined to the second part. In that way the material for the first part may be chosen for being highly wear resistant. On the other hand the material of the second part (17) may be chosen for being well-suited for a joining process.

8 Claims, 1 Drawing Sheet

U.S. PATENT DOCUMENTS

| | | | | |
|---|---|---|---|---|
| 5,241,935 | A * | 9/1993 | Beck et al. | 123/300 |
| 6,260,775 | B1 * | 7/2001 | Lambert et al. | 239/533.3 |
| 6,279,842 | B1 * | 8/2001 | Spain | 239/585.1 |
| 6,561,436 | B1 * | 5/2003 | Boecking | 239/102.2 |
| 6,575,385 | B1 | 6/2003 | Stier | 239/102.2 |
| 6,685,105 | B1 | 2/2004 | Ruehle et al. | 239/102.1 |
| 6,776,354 | B2 * | 8/2004 | Cooke | 239/102.2 |
| 6,929,192 | B2 | 8/2005 | Schmauser | 239/102.2 |
| 2001/0002681 | A1 * | 6/2001 | Willke et al. | 239/585.4 |
| 2001/0007338 | A1 * | 7/2001 | Popp | 239/132.5 |
| 2001/0032893 | A1 * | 10/2001 | Lambert | 239/533.3 |
| 2002/0043575 | A1 * | 4/2002 | Sekine et al. | 239/585.1 |
| 2003/0111563 | A1 * | 6/2003 | Tsuchiya et al. | 239/585.1 |
| 2004/0046138 | A1 | 3/2004 | Stein et al. | 251/129.06 |
| 2008/0257990 | A1 * | 10/2008 | Matteucci et al. | 239/533.9 |

FOREIGN PATENT DOCUMENTS

| | | | |
|---|---|---|---|
| DE | 03/016707 | A1 | 2/2003 |
| GB | 128 017 | A | 6/1919 |
| JP | 01 009084 | A | 1/1989 |

OTHER PUBLICATIONS

International Search Report and Written Opinion for International Patent Application No. PCT/EP2005/050192 (12 pages), May 27, 2005.

* cited by examiner

FLUID INJECTOR

CROSS-REFERENCE TO RELATED APPLICATIONS

This application is a U.S. national stage application of International Application No. PCT/EP2005/050192 filed Jan. 18, 2005, which designates the United States of America, and claims priority to European application number EP04004592.4 filed Feb. 27, 2004 the contents of which are hereby incorporated by reference in their entirety.

TECHNICAL FIELD

The invention relates to a fluid injector. Known fluid injectors comprise a housing, a valve body and an actuator unit, which is inserted into the housing. The valve body comprises a cartridge with a recess, that takes in a needle. A pretensioned spring rests on a body, that is fixed to the needle. The pretensioned return spring rests, on the other hand, on a spring rest which is formed in the valve body. In addition to that the actuator unit acts on the needle.

BACKGROUND

Depending on the force balance of the actuator unit and the return spring the needle opens or closes a nozzle and in that way controls the injection of fuel. In an increasing number of applications actuator units with a piezoelectric actuator are used. They have the advantage of having a very fast response time to actuating signals and like that enable multiple injections into a cylinder of the internal combustion engine during one working cycle of the cylinder.

Piezoelectric actuators are very sensitive to fuel. For that reason they need to be sealed from the flow of fuel or other fluids. In this respect it is known to join one of the free ends of a metal bellow to the needle, for example by welding, and to join the metal bellow on its other free end to another element and in that way to establish a sealing. However materials for the needle that are well-suited for welding are often not well-suited for a reliable long-lasting operation of the needle in view of frequent opening and closing of the nozzle.

WO 03/016707 A1 discloses a fluid injector with a connector to a fuel supply, a housing, an actuator unit, and a valve body. The housing is double tubed and has a recess, which takes in the actuator unit. The actuator unit comprises a piezoelectric actuator, which acts on the needle. Between the walls of the double tube-shaped housing the fuel is led from the connector to a fuel inlet of the valve body. The valve body has a housing part with a recess, that takes in a needle. Depending on the position of the needle a nozzle is opened or closed and respectively fuel is injected or not.

SUMMARY

The object of the invention is to create a fluid injector, which is simple and ensures a reliable operation for a long operating time.

The invention is distinguished by a fluid injector with an actuator unit and a cartridge which comprises a recess which forms an injection nozzle on one of its open ends and takes in a needle. The needle comprises a first and a second part, with the first part being inserted into the recess and closing or opening the injection nozzle depending on the position of the first part. The second part is coupled to the actuator unit on one of its free ends and is coupled to the first part by a coupling unit. The coupling unit is arranged in a positive connection to the first part and is joined to the second part. In that way the material of the first part may be chosen to be best suited for ensuring a reliable and wear-resistant operation of the opening and closing of the injection nozzle. On the other hand the material of the second part of the needle may be chosen to be well-suited for a joining process, in particular for a welding process. In this way, for example, a metal bellow may be joined to a second part of the needle in a reliable way.

In an advantageous embodiment of the invention the coupling unit forms a spring rest, in which a return spring rests, that urges the needle in a position where the injection nozzle is closed. In that way the coupling unit serves the double purpose of on the one hand coupling the first and second part of the needle reliably and on the other hand forming the spring rest. This has the advantage that less parts are needed for the fluid injector which results in lower manufacturing costs.

In a further advantageous embodiment of the invention a receptance is formed in the first part and fixes a keeper in axial direction relative to the needle. A coupling body, which has a recess through which the first part protrudes and which takes in the keeper and fixes it in the radial direction relative to the needle. The coupling body is joined to the second part. This has the advantage, that the coupling unit is simple to manufacture and to assemble and with a properly formed receptance tolerances in the length of the needle may be compensated for.

In a further advantageous embodiment of the invention the coupling unit is joined to the second part by welding. This has the advantage that a highly loadable connection between the second part and the coupling unit is established, which is wear-resistant even under frequent operation and under severe operating conditions.

BRIEF DESCRIPTION OF THE DRAWINGS

Exemplary embodiments of the invention are explained in the following with the aid of schematic drawings. These are as follows.

Elements of the same design or function that occur in different illustrations are identified by the same reference character.

DETAILED DESCRIPTION

Figure 1:
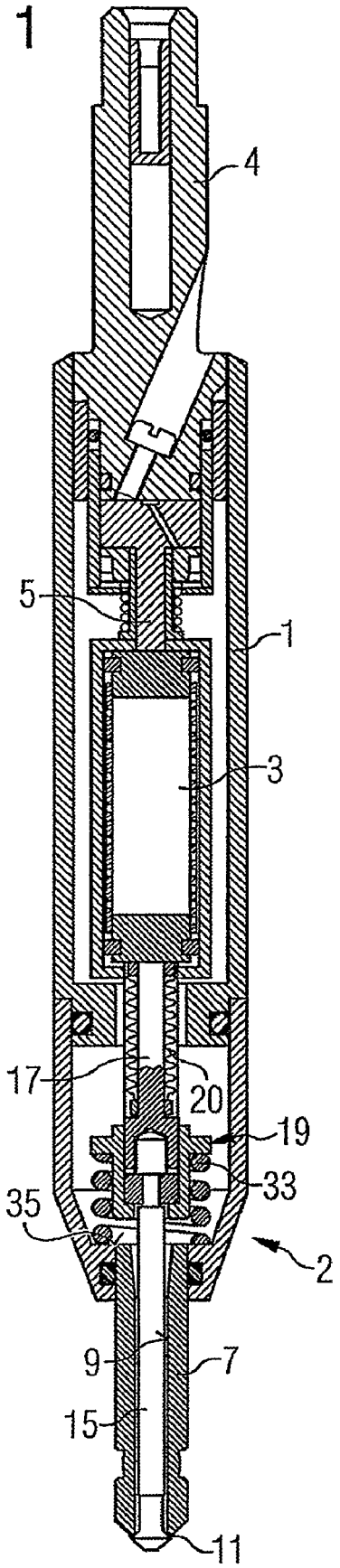
FIG. 1 a fluid injector.
Figure 2:
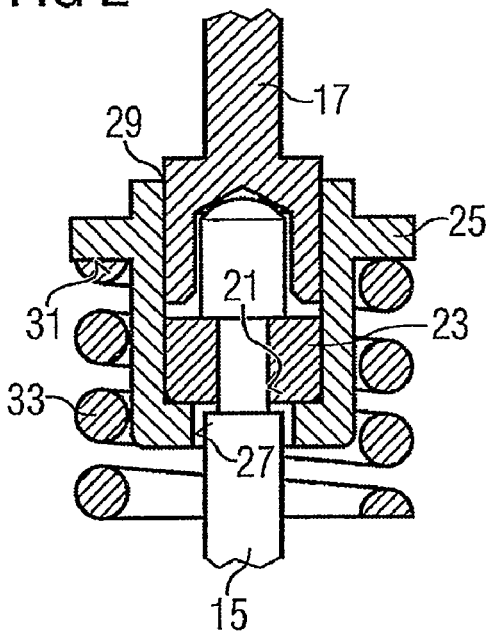
FIG. 2 an enlargement of part of the fluid injector showing a coupling unit.

A fluid injector (FIG. 1) that is used as a fuel injector for an internal combustion engine, comprises a housing 1, a valve body 2, an actuator unit 3, a fuel connector 4 and a thermal compensator 5. The fuel connector 4 is designed to be connected to a high-pressure fuel chamber of an internal combustion engine, where fuel is stored under high pressure, for example under the pressure of about 200 Bar.

The housing 1 has a tubular shape. The fuel connector 4 is fixed to the housing 1 on one of its free ends. The thermal compensator 5 is inserted into the housing 1 and contacts the actuator unit 3. The actuator unit 3 comprises in a preferred embodiment a piezo actuator, which changes its axial length depending on a control signal applied to it. The actuator unit 3 may however also comprise another type of actuator unit, which is known to a person skilled in the art for that purpose. Such an actuator unit may be, for example, a solenoid.

The fluid injector further comprises the valve body 2. The valve body 2 comprises a cartridge 7 with a recess 9 which is axially lead through the cartridge 7. A needle is taken in the recess 9 of the cartridge 7. On one of the free ends of the recess 9 an injection nozzle 11 is formed which is opened or closed depending on an axial position of a first part 15 of the needle. In addition to that the needle comprises a second part 17 which is coupled to the actuator unit 3 on one of its free ends and is coupled to the first part 15 via a coupling unit 19. The coupling unit 19 is arranged in positive connection, that is in form closure, to the first part 15 and is joined to the second part 17.

The first part 15 of the needle consists of a material that is preferably very hard and extremely wear-resistant and in this way enables a long-lasting operation of the injection nozzle 11. The first part 15 of the needle is put under heavy strain in its area that is in sealing contact with a seat formed in the cartridge 7 in the area of the injection nozzle 11. This is caused by the movements into the seat formed in the cartridge 7. In modern internal combustion engines such fuel injectors are operated under a very high frequency because fuel is under certain load conditions, injected several times during one operating cycle of a cylinder of the internal combustion engine. For this reason the first part 15 of the needle is formed of a very strain-resistant material.

The second part 17 of the needle is coupled to the actuator unit 3. In addition to that a bellow 20 is joined on one of its free ends to the second part 17 of the needle. The bellow 20 is preferably a metal bellow and is preferably joined to the second part 17 of the needle by welding, especially by laser welding. The bellow 17 is joined on its other free end to a part of the actuator unit 3, also preferably by welding. In that way the bellow seals a stack of piezoelectric elements of the actuator unit 3 from the liquid, especially the fuel which flows around the actuator unit towards the valve body 2 and then further enters the recess 9 of the cartridge 7. The material of the second part 17 of the needle may be chosen for being well-suited for welding.

The coupling unit 19 is provided for coupling the first and second part 15, 17 of the needle. The coupling unit comprises 1 keeper 23, which is kept in a receptance 21 of the first part 15 of the needle. The keeper 23 is preferably shaped in the form of a ring with a slot so it can be inserted radially relative to the first part 15 of the needle. The receptance 21 is formed preferably as a groove, which limits the axial positions of an introduced keeper 23. Preferably the receptance 21 has a slightly larger axial extension than the keeper 23.

A coupling body 25 has a recess 27, through which the first part 15 of the needle protrudes and which takes in the keeper 23 and fixes it in the radial direction relative to the first part 15 of the needle. The second part 17 of the needle is also taken in into the recess 27 and is fixed to the coupling body 27 by a joining operation, preferably by welding. A welding seam 29 therefore exists in the area where the second part 17 of the needle and the coupling body are joined together.

The second part 17 and the coupling body 25 may also be joined in another way, that a person skilled in the art considers suitable for that purpose, for example by soldering. The second part 17 of the needle may also be formed in another way and arranged in a respectively other way which makes it suitable for being joined to the coupling body 25. Alternatively the coupling body 25 and the keeper 23 may be formed in one part, which means to be formed in a way that it can be inserted into the receptance 21.

In addition to that a first spring rest 31 may be formed in part of the coupling body 25. This first spring rest 31 then serves as a spring rest for return spring 33 which, on the other hand, rests on a second spring rest 35 and urges the needle in a position where the injection nozzle 11 is closed.

What is claimed is:

1. A fluid injector comprising an actuator unit; and a cartridge which comprises a recess, which on one of its open ends forms an injection nozzle and takes in a needle; wherein the needle comprises a first and second part with the first part being inserted into the recess and closing or opening the injection nozzle depending on the position of the first part, wherein the second part being coupled to the actuator unit on one of its free ends and being coupled to the first part via a coupling unit, which is arranged in positive connection to the first part and is joined to the second part;

wherein the actuator unit, the second part of the needle, and the first part of the needle are arranged substantially end-to-end in that order along an axial length of the fluid injector, such that movement of the actuator unit acts on the second part of the needle, which in turn acts on the first part of the needle to move the first part of the needle; and wherein a receptance is formed in the first part of the needle and fixes a keeper in axial direction relative to the first part of the needle, and a coupling body, which has a recess, through which the first part of the needle protrudes and which takes in the keeper such that keeper fits substantially tightly within the recess to substantially prevent any radial movement of the keeper and the first part of the needle relative to the second part of the needle and with the coupling body being joined to the second part of the needle, wherein the recess has an inner diameter, the first part of the needle has an outer diameter smaller than the inner diameter of the recess such that the first part of the needle can pass through the recess, and the keeper has an outer diameter larger than the inner diameter of the recess such that the keeper cannot pass through the recess.

2. A fluid injector according to claim 1, wherein the coupling unit forms a spring rest, on which a return spring rests, that urges the needle in a position in which the injection nozzle is closed.

3. A fluid injector according to claim 1, wherein the coupling unit is joined to the second part by welding.

4. A fluid injector comprising an actuator unit;

a cartridge which comprises a recess, which on one of its open ends forms an injection nozzle; and a needle comprising a first and second part with the first part being inserted into the recess and closing or opening the injection nozzle depending on the position of the first part, wherein the second part being coupled to the actuator unit on one of its free ends and being coupled to the first part via a coupling unit, which is arranged in positive connection to the first part and is joined to the second part;

wherein the actuator unit, the second part of the needle, and the first part of the needle are arranged substantially end-to-end in that order along an axial length of the fluid injector, such that movement of the actuator unit acts on the second part of the needle, which in turn acts on the first part of the needle to move the first part of the needle; and wherein a receptance is formed in the first part of the needle and fixes a keeper in axial direction relative to the first part of the needle, and a coupling body, which has a recess, through which the first part of the needle protrudes and which takes in the keeper such that keeper fits substantially tightly within the recess to substantially prevent any radial movement of the keeper and the first part of the needle relative to the second part of the needle and with the coupling body being joined to the second part of the needle, wherein the recess has an inner diameter, the first part of the needle has an outer diameter smaller than the inner diameter of the recess such that the first part of the needle can pass through the recess, and the keeper has an outer diameter larger than the inner diameter of the recess such that the keeper cannot pass through the recess.

5. A fluid injector according to claim 1, wherein the coupling unit forms a spring rest, on which a return spring rests, that urges the needle in a position in which the injection nozzle is closed.

6. A fluid injector according to claim 4, wherein the coupling unit is joined to the second part by welding.

7. A fluid injector comprising an actuator unit;

a cartridge which comprises a recess, which on one of its open ends forms an injection nozzle;

a needle comprising a first and second part with the first part being inserted into the recess and closing or opening the injection nozzle depending on the position of the first part, wherein the second part being coupled to the actuator unit on one of its free ends and being coupled to the first part via a coupling unit, which is arranged in positive connection to the first part and is joined to the second part, wherein the coupling unit forms a spring rest, on which a return spring rests, that urges the needle in a position in which the injection nozzle is closed, and wherein the actuator unit, the second part of the needle, and the first part of the needle are arranged substantially end-to-end in that order along an axial length of the fluid injector; and a receptance, which is formed in the first part of the needle and fixes a keeper in axial direction relative to the first part of the needle, and a coupling body, which has a recess, through which the first part of the needle protrudes and which takes in the keeper and fixes it in the radial direction relative to the first part of the needle and with the coupling body being joined to the second part of the needle, wherein the recess has an inner diameter, the first part of the needle has an outer diameter smaller than the inner diameter of the recess such that the first part of the needle can pass through the recess, and the keeper has an outer diameter larger than the inner diameter of the recess such that the keeper cannot pass through the recess.

8. A fluid injector according to claim 7, wherein the coupling unit is joined to the second part by welding.

* * * * *